US005772489A

United States Patent [19]

Sherer et al.

[11] Patent Number: 5,772,489

[45] Date of Patent: Jun. 30, 1998

[54] BALLOON DETONATORS

[76] Inventors: Ronald B. Sherer, 103 S. Shaffer Dr., New Freedom, Pa. 17349; James O. Watkins, 14920 Mt. Nebo Rd., Poolesville, Md. 20837

[21] Appl. No.: 685,308

[22] Filed: Jul. 23, 1996

Related U.S. Application Data

[63] Continuation-in-part of Ser. No. 515,276, Aug. 15, 1995, Pat. No. 5,538,451.

[51] Int. Cl.[6] ..... A63H 37/00

[52] U.S. Cl. ..... 446/14; 446/220; 446/484; 446/397; 446/398

[58] Field of Search ..... 446/14, 220, 484, 446/397, 398; 472/51, 53, 56, 134

[56] References Cited

U.S. PATENT DOCUMENTS

| | | | |
|---|---|---|---|
| 1,915,721 | 6/1933 | Diaz . | |
| 2,856,732 | 10/1958 | Weismantel . | |
| 4,226,115 | 10/1980 | Williams et al. . | |
| 4,292,999 | 10/1981 | Szollman | 446/220 |
| 4,425,117 | 1/1984 | Hugemann et al. | 604/93 |
| 4,638,207 | 1/1987 | Radice | 446/220 |
| 5,117,344 | 5/1992 | Perez | 446/220 |
| 5,443,495 | 8/1995 | Buscemi et al. | 623/1 |

*Primary Examiner*—Robert A. Hafer
*Assistant Examiner*—Jeffrey D. Carlson
*Attorney, Agent, or Firm*—Ronald B. Sherer

[57] ABSTRACT

A detonator for exploding amusement balloons is disclosed in which the detonator comprises a pair of electrical lead wires electrically connected at their ends by a small-gage filament, which filament may be a standard office-type staple, and the detonator may be covered by an intermediate layer of material between the detonator and the balloon wall through which layer heat passes from the heated filament to the balloon wall to cause the balloon to explodes.

20 Claims, 3 Drawing Sheets

BALLOON DETONATORS

This Application is a Continuation-In-Part of application Ser. No. 08/515,276, filed Aug. 15, 1995, now U.S. Pat. 5,538,451, the complete disclosure of which is hereby incorporated by reference.

Field of the Invention

This Application relates to the field of exploding toy or amusement balloons for theatrical and amusement purposes, and more particularly, to a non-explosive and non-flammable detonator for exploding such balloons safely, reliably and at low cost.

Background

The exploding of amusement balloons, with or without confetti inside the balloon, has become an increasingly popular crowd-pleasing device at corporate and political conventions, sporting events, professional and non-professional parties and theatrical performances. However, the exploding of balloons for amusement purposes has been seriously inhibited by the fact that, prior to the detonator disclosed in the above-identified parent Application, balloon detonators comprised explosive and/or highly flammable charges which posed significant risks of causing a fire. The above-identified parent Application discloses, in brief, that a highly reliable balloon detonator may comprise only a pair of electrically conductive lead wires connected to a voltage source and an electrically conductive filament with no explosive and/or flammable charge. Instead, the filament is selected of such material and gage that it becomes heated upon the flow of a small amount of electrical current such that the heated filament weakens the wall of the inflated balloon and the balloon explodes as a result of its own internal superatmospheric pressure. Thus, there is absolutely no danger of fire even though latex balloons are flammable if ignited by a flame.

The above-described balloon detonator has proven to be extremely safe, effective and reliable. At the same time, the manufacturing step of mechanically and electrically connecting the small-gage filament wire to the stripped ends of the lead wires is a relatively slow and time-consuming step. This disadvantage is removed by the present invention. Also, it has now been discovered that the filament may be separated from the balloon wall by an intermediate layer, such as a piece of tape, for example, and still heat the balloon sufficiently to instantaneously explode the balloon by the passage of heat from the filament through the intermediate layer to the balloon wall. In this regard, it has been found that an intermediate layer, such as a wrapped layer about the detonator, substantially improves the rigidity and electrical integrity of the detonator, such as during shipment and handling of the detonator and application to the balloon. These and other objects and advantages will become more fully apparent from the following description of several preferred embodiments of the present invention as illustrated in the following drawings.

DETAILED DESCRIPTION

Figure 1:
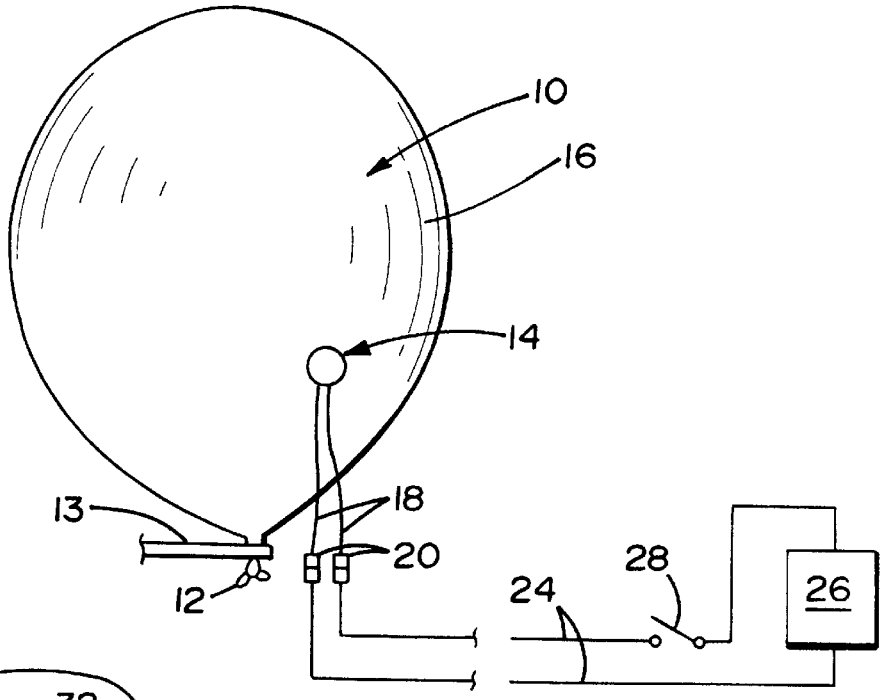
FIG. 1 is a schematic illustration of a balloon with a detonator attached as more fully described in said co-pending Application and said Patent.

FIG. 1 schematically illustrates a balloon 10, having an inflated outer wall 16, secured by stem 12 to a mounting 13. The balloon may be filled with helium such that the stem portion 12 is pointed downwardly, as illustrated, or the balloon may be filled with air, nitrogen, or other gas and be mounted at the ceiling with the stem pointed upwardly as is preferred when the balloon is partially filled with confetti or other lightweight objects to be dispersed when the balloon is exploded. Also, it will be understood that the balloon may be one of many balloons such as when mounted, for example, in a balloon bouquet, or a balloon wall, or a marquis made of balloons.

As further shown in FIG. 1, a non-flammable, non-explosive electrical detonator 14 is attached to balloon wall 16 by adhesive means such as an adhesive coating or strip, and detonator 14 is connected to an electrical power source 26 by a pair of lead wires 18; such as through connectors 20, circuit wires 24 and switch means 28. As most clearly shown in FIG. 2, the detonator 14 may comprise the stripped or otherwise bared ends 34 of insulated lead wires 18 and an electrically conductive filament wire 30 which is connected at opposite ends to the bared ends of lead wires 18. As illustrated in this FIG., filament wire 30 may be attached to the balloon by a piece of adhesive-coated tape 32 as one means of securing the detonator to the balloon.

As further described in said parent Application and said Patent, the composition and gage of lead wires 18 and circuit wires 24 relative to that of filament wire 30 is selected such that, upon closure of switch means 28, the flow of current from power source 26 does not appreciably heat the circuit or lead wires, but does significantly heat the filament wire. The localized and focused heat of the hot filament wire weakens wall 16 of the balloon and the balloon explodes due to the superatmospheric pressure within the balloon; not because of any flammable or explosive charge as previously required.

Figure 2:
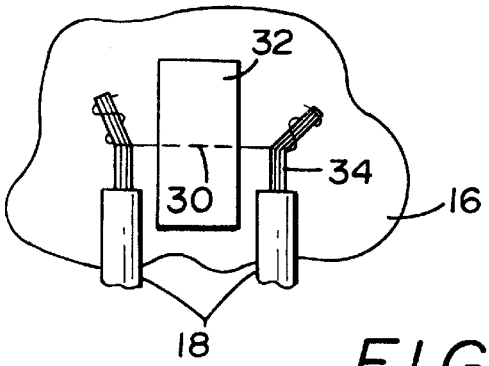
FIG. 2 is a partial, top plan view of the detonator as further described in said co-pending Application and said Patent.

As shown in FIG. 2, and as further described in said co-pending Application and said Patent, it is necessary to mechanically and electrically connect the ends of the fine, small-diameter filament wire 30 to the bared ends 34 of lead wires 18. This may be accomplished by twisting the ends of the filament wire about the bared ends of the lead wires as illustrated, or by soldering or otherwise mechanically and electrically connecting the fine filament wire to the lead wires as further disclosed in said co-pending Application and said Patent. This step is critical to the reliability of the detonator, and particularly when a low voltage power source of only a few volts is utilized, since a failure to achieve a solid electrical connection between the filament wire and the lead wires may result in a failure to heat the filament sufficiently and, as a result, a failure to explode the balloon.

Figure 4:
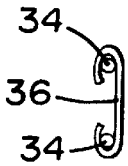
FIG. 4 is an end view taken along the view line 4—4 of FIG. 3.
Figure 3:
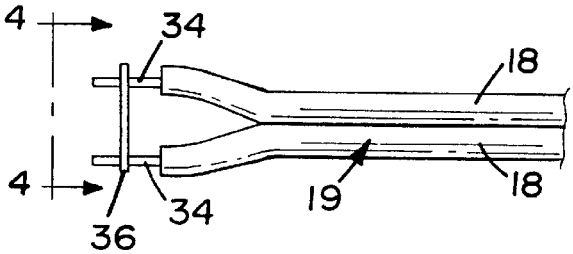
FIG. 3 is a top plan view of one embodiment of the detonator of the present invention.

It has now been discovered that, although commercially available, office-type staples are not designed as electrical components of any type, such a staple may be employed as the filament in the present invention. This is illustrated schematically in FIGS. 3 and 4 wherein lead wires 18 are illustrated as comprising a single insulated wire 19 such as, for example, standard so-called "lamp cord" wire 19 having a gage of the individual wires in the order of 16–18 gage. The ends of the individual wires 18 are stripped of their insulation so as to form bared ends 34, and a staple 36 is stapled around ends 34 as more clearly shown in FIG. 4. As illustrated, staple 36 wraps around the bared ends of the lead wires thereby making solid electrical and mechanical contact with the ends of the lead wires. This step in the manufacturing process is extremely rapid and low-cost compared to other methods of mechanical and electrical connection of the filament to the lead wires. Moreover, even though the standard, office-type staple is not designed as an electrical component, the relative conductivity and resistivity of the staple has been discovered to be ideal for generating more than sufficient heat to explode the balloon, even when power source 26 comprises only a pair of D-size flashlight batteries, preferably of the Ni—Cd rechargeable type, connected in series such as to produce a nominal 3 volts D.C. In addition, it has been discovered that depending upon the voltage of the power source, and the gage and length of the lead wires, it is possible to heat the staple sufficiently to explode the balloon without causing the staple to melt, thereby making the detonator reusable with the same staple.

Figure 6:
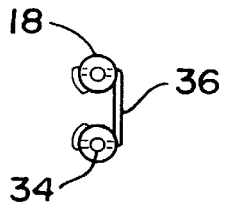
FIG. 6 is an end view taken along view line 6—6 of FIG. 5.
Figure 5:
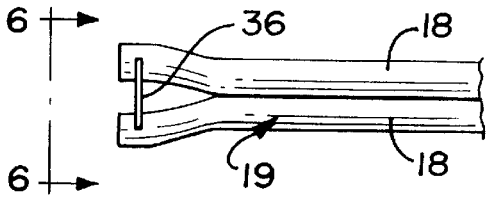
FIG. 5 is a top plan view of a second embodiment of the detonator of the present invention.

As further illustrated in FIGS. 5 and 6, it has also been discovered that it is not necessary to perform the preparatory step of stripping the insulation from the lead wires prior to attaching the staple/filament. Instead, the insulated ends of wire 19 may be inserted into a standard, commercially available manual or automatic stapler such that staple 36 is driven through the insulation, and through the multi-strands of leads 18 so as to make solid electrical contact with the leads, and also bend the legs of the staple under the insulation surrounding the leads as illustrated in FIG. 6. This eliminates the step of stripping or otherwise baring the ends of the lead wires while, at the same time, producing a detonator of high reliability at substantially lower cost of manufacture.

Figure 7:
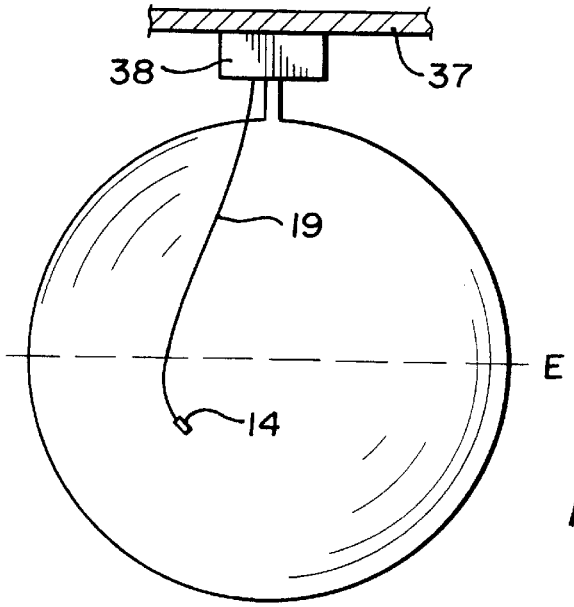
FIG. 7 is a side elevational view of a balloon mounted at the ceiling with a detonator of the present invention attached.

It has also been discovered that the gage of the lead wires may be substantially smaller than the 16–18 gage lamp cord wire previously mentioned by way of example. For example, it has been discovered that for lead wires as long as five feet, which are sufficient to surround half of a five-foot diameter balloon, lead wires having a gage as small as 24 gage may be employed. As a result, it has been discovered that, as illustrated in FIG. 7, a five-foot diameter balloon mounted at a ceiling 37 and partially filled with confetti or other lightweight objects, may be exploded with a very narrow, almost invisible lead wire 19. This is true even when the detonator 14 is positioned substantially below the equator E of the balloon; this location of the detonator having been discovered as the optimum location of the detonator for dispersing the contents of the balloon over the widest area.

Figure 8:
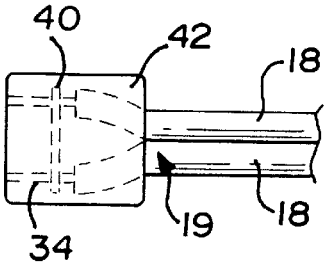
FIG. 8 is a top plan view of a detonator having an intermediate layer wrapped about the detonator.
Figure 9:
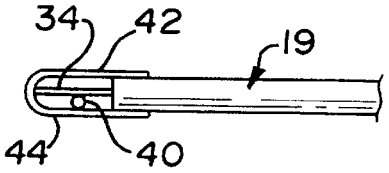
FIG. 9 is a side view of the detonator of FIG. 8.

As previously stated, it has also been discovered that the filament need not be in contact with the wall of the balloon in order to cause the balloon to explode. That is, it has been discovered that the heat of the filament, whether the filament is a small-gage wire or a staple, is sufficient to pass through an intermediate layer and still explode the balloon instantly upon closure of switch means 28. This is illustrated schematically in FIGS. 8 and 9 wherein a lead wire 19 having bared ends 34 is shown as having a filament 40, which may be a straight wire or a staple as previously described, surrounded on both sides by layers 42 and 44. Layers 42 and 44 may be separate pieces of plastic, paper, foam or tape, such as pieces of adhesive tape, Duct® tape, Scotch® brand tape, or other types of adhesive-coated tape. Alternatively, the support layers may comprise the same piece folded back in a U-shape as illustrated in FIG. 9.

In the illustrations of FIGS. 3–9 it has been assumed that the width of staples 36 and 40 is greater than the width of lead wire 19 such that the ends of the lead wire must be spread apart as illustrated. This is the case with standard-size staples, such as Bostitch® staples, which are approximately ½ in wide, and also in the case of TOT®50® brand staples manufactured by ACCO USA which are approximately ⅜ inch wide; standard 16 gage lamp cord wire being approximately ¼ inch wide. The width of the lead wires and the staples or straight filament wires is of no consequence in those applications where the detonator and lead wires are not seen by the audience as in the case of a balloon bouquet, or balloon wall or marquis where the lead wires and detonator are not visible. However, in the case of individual balloons, such as a plurality of individual balloons mounted at the ceiling in a convention room or ballroom, it is critically important that the lead wires and detonators be as inconspicuous as possible. Accordingly, it has now been discovered that lead wires as small as 24 gage can be employed even with power sources as small as 1.5–3.0 volts, such as supplied by conventional rechargeable flashlight batteries, and even when the length of the lead wires is as long as five feet so as to extend to the bottom of the balloon for optimum dispersion of the contents of the balloon over the widest area.

Figure 10:
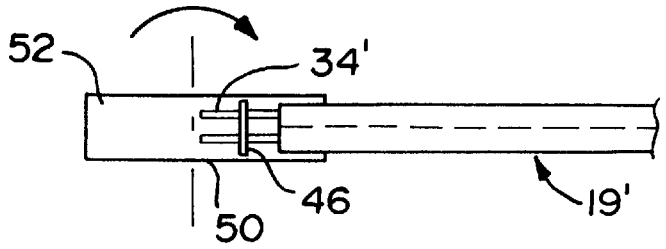
FIG. 10 is a top plan view of a further embodiment of the detonator during the application of the wrapped intermediate layer.

This is illustrated in FIG. 10 wherein a lead wire 19' of 24 gage wire or smaller is shown substantially enlarged. Filament 46 may be a staple or a straight length of wire having a gage in the order of 24 gage or smaller such as, for example, 25–30 gage wire. The width of 24 gage wire is in the order of ⅛ inch such that, on a 3–5 foot diameter balloon, the lead wire is substantially invisible. Lead wire 19' terminates in bared ends 34' and filament wire 46 is laid across the ends, or stapled thereto. The lead wires and filament are placed on, or stapled to, a short piece of tape 50 having an adhesive layer. End 52 of the tape is then folded over ends 34' and filament 46 to form a sandwich construction as previously described with reference to FIG. 9. Thus, in this embodiment, the width of the detonator is essentially that of lead wire 19', or approximately ⅛ inch wide, such that the detonator is substantially invisible to the audience.

With respect to power sources, standard 110–115v AC current may be used if desired. However, if the balloon is at the ceiling, relatively long circuit wires 24 must be used to reach an outlet. Accordingly, it is preferred to use batteries, and preferably rechargeable batteries, which can be located adjacent the balloon such as in mounting box 38 shown in FIG. 7. With short lead wires 18, such as in the order of a few inches to one foot, and with a large gage lead wire, one D size flashlight battery of 1.5V DC is sufficient to heat the filament and explode the balloon. When longer lead wires are used, or when smaller gage leads such as 24 gage speaker wire are used, the power source should be of higher voltage such as 3 to 6 volts DC. This voltage may be obtained from 2 D size batteries connected in series, or one 3.2V rechargeable battery of the type used for operating power tools. Where a large plurality of balloons are to be exploded simultaneously from a single battery, a higher voltage may be required, and this may be supplied from a 6 or 12V automotive or marine battery.

Figure 11:
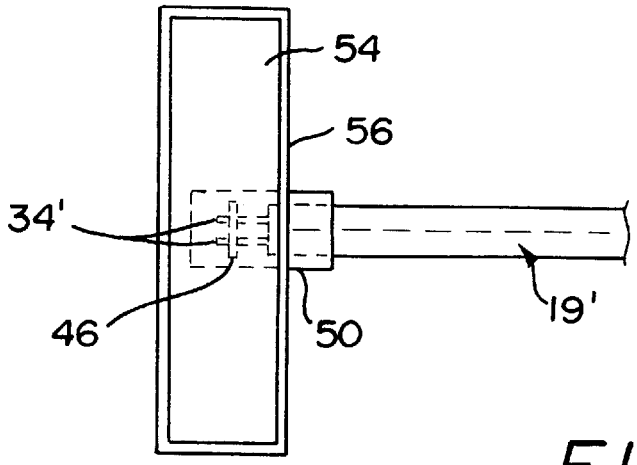
FIG. 11 is a top plan view of the detonator of FIG. 10 with an adhesive strip attached.

With regard to mounting the detonator on the balloon, the detonator may be taped to the balloon by a piece of tape having an adhesive layer as shown in FIG. 2. Thus, the stapled detonators of FIGS. 3–6 may be directly attached to the balloon wall by a piece of clear or Magic Scotch® brand tape, or colored adhesive tape having a color to match that of the balloon. Similarly, the covered or wrapped detonators of FIGS. 8–10 may be attached to the balloon by a piece of tape 54 extending over the wrapped detonator as shown in FIG. 11, and the adhesive side of tape 54, which is facing downwardly in FIG. 11, may be covered by a piece of low-stick material or "peel-off" layer 56 for purposes of handling and shipping the detonator. At the location of use, peel-off layer 56 is simply removed and the detonator is ready to be secured to the balloon wall by adhesive-coated tape 54.

Figure 13:
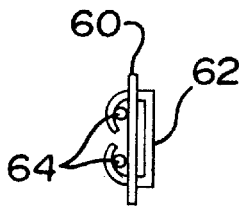
FIG. 13 is an end view taken along view line 13—13 of FIG. 12.
Figure 12:
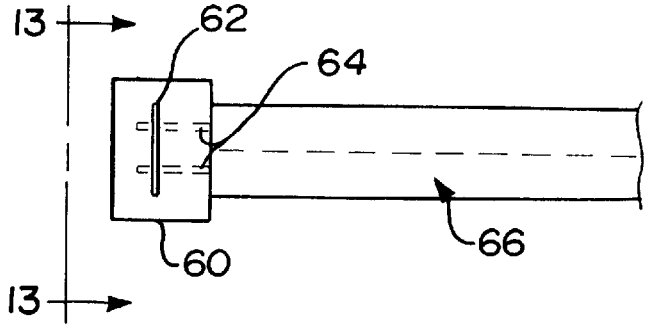
FIG. 12 is a top plan view of a further embodiment of the detonator including a support layer.

Lastly, it has also been discovered that the mechanical and electrical integrity of the stapled detonator may be further improved, particularly when the lead wires are of very small gage, by stapling the staple and lead wires to a support layer such as support layer 60 shown in FIGS. 12 and 13. FIGS. 12–13 are substantially enlarged in order to more clearly show filament staple 62 extending from the top side of support layer 60 through the layer and being crimped against the bared ends 64 of lead wire 66. In this manner it has been found that the support layer acts as a filler or cushion which further ensures that the crimped legs of the staple are in solid mechanical and electrical contact with each of the very fine, small-gage lead wires. Alternatively, it will be understood that the lead wires may be placed on the top of the support layer, as viewed in FIG. 12 instead of under the layer as shown, such that the staple filament contacts the lead wires on the top of the support layer while the legs of the staple are crimped under the support layer.

The support layer may be composed of any of the types of tape disclosed above, or it may be composed of a thin piece of cardboard, plastic or other material. One preferred material is plastic foam tape having a thickness in the order of 1/32 to 1/8 inch. Such foam tape compresses when stapled such as to provide tight contact between the staple and the lead wires during shipment and handling of the detonator. As in the previous embodiments, the detonator may be taped to the balloon as previously described, and it will be understood that the support layer may comprise a portion of the tape used to attach the detonator to the balloon.

From the foregoing description of several preferred embodiments it will be apparent that the present invention provides a completely safe detonator, which does not comprise any explosive or flammable charge, and which is extremely simple to manufacture such as to be of low cost, and which is sufficiently small such as to be inconspicuous on a balloon, and yet is highly reliable and requires only a low voltage power source. It will also be apparent that numerous variations may be made based upon the illustrated embodiments, and it is to be understood that the foregoing description of several embodiments is intended to be illustrative of the principles of the invention, and not exhaustive thereof, and that the invention is intended to be limited only as set forth in the following claims interpreted under the doctrine of equivalents.

What is claimed is:

1. A detonator for exploding an amusement balloon comprising:

(a) a pair of lead wires having first and second ends;

(b) a staple extending between said lead wires in stapled electrical contact with each of said lead wires at said first ends, said staple having a first side for attachment to a balloon; and (c) a planar layer of material covering said first side of said staple.

2. The balloon detonator of claim 1 wherein said layer of material comprises a piece of thin, flexible material.

3. The balloon detonator of claim 1 further including a support layer, said support layer being stapled to said lead wires by said staple filament.

4. The balloon detonator of claim 3 wherein said support layer has a thickness in the order of 1/32 to 1/8 of an inch.

5. The balloon detonator of claim 1 wherein said layer of material comprises a layer of double-stick tape for adhering said detonator to a balloon.

6. A detonator for exploding an amusement balloon comprising:

(a) a pair of electrically conductive lead wires having first and second ends;

(b) a filament, said filament having a first end connected to said first end of one of said lead wires and said filament having a second end connected to said first end of the other lead wire;

(c) a first planar layer of material covering one side of said filament;

(d) a second planar layer of material covering the other side of said filament such that said filament is sandwiched between said first and second layers; and (e) adhesive means between said first and second layers securing said layers together with said filament therebetween.

7. The detonator of claim 6 wherein at least one of said first and second layers is composed of thin, flexible material.

8. The detonator of claim 7 wherein each of said first and second layers are composed of thin, flexible material.

9. The detonator of claim 7 wherein said thin, flexible material is composed of tape having an adhesive coating facing the other layer.

10. The detonator of claim 6 wherein one of said layers includes aperture means for exposing said filament.

11. The detonator of claim 6 wherein said filament comprises a filament wire having a gage smaller than the gage of said lead wires.

12. The detonator of claim 6 wherein said filament comprises a staple having its ends stapled to said first ends of said lead wires.

13. The detonator of claim 6 including layer of adhesive means secured to the detonator and a peel-off layer of low-stick material covering said adhesive means for rapidly and easily securing the detonator to a balloon.

14. A detonator for exploding amusement balloons comprising:

(a) a pair of insulated lead wires having bared ends;

(b) a staple stapled across said bared ends; and (c) means for attaching the stapled end of said lead wires to an amusement balloon.

15. The balloon detonator of claim 14 including a first layer of support material, said first layer being positioned between said staple and the amusement balloon for the passage of heat from said staple through said support layer to the balloon.

16. The balloon detonator of claim 15 including a second support layer covering the other side of said staple.

17. The balloon detonator of claim 16 wherein said first and second layers comprise a single piece of material folded over said one and said other sides of said staple.

18. The balloon detonator of claim 17 wherein said material is a piece of tape having an adhesive coating.

19. A balloon detonator for exploding amusement balloons comprising:

(a) a pair of lead wires having first ends and insulated coatings covering said first ends;

(b) a staple extending through said insulated coatings and electrically connecting said first ends; and (c) means for attaching the stapled end of said lead wires to an amusement balloon.

20. The balloon detonator of claim 19 including a support layer between said staple and the balloon.

* * * * *